United States Patent [19]

Berentzen

[11] Patent Number: 4,905,364

[45] Date of Patent: Mar. 6, 1990

[54] METHOD FOR PRODUCING THE LATCH BEARING IN A LATCH NEEDLE FOR TEXTILE MACHINES

[75] Inventor: Hardo Berentzen, Albstadt, Fed. Rep. of Germany

[73] Assignee: Theodor Groz & Söhne & Ernst Beckert Nadelfabrik Commandit-Gesellschaft, Albstadt-Ebingen, Fed. Rep. of Germany

[21] Appl. No.: 298,246

[22] Filed: Jan. 12, 1989

[30] Foreign Application Priority Data

Jan. 14, 1988 [DE] Fed. Rep. of Germany ..... 3800802

[51] Int. Cl.[4] ..... B23D 17/00

[52] U.S. Cl. ..... 29/413; 29/414; 29/418; 29/458

[58] Field of Search ..... 29/412, 413, 414, 418, 29/458, 464; 66/121, 122

[56] References Cited

U.S. PATENT DOCUMENTS

| | | | |
|---|---|---|---|
| 1,798,890 | 3/1931 | Mayo et al. | 66/122 |
| 1,928,964 | 10/1933 | Currier | 66/122 |
| 3,568,472 | 3/1971 | Berentzen | 66/122 |
| 3,677,035 | 7/1972 | Wiederhut et al. | 66/122 |
| 3,934,109 | 1/1976 | Shepard et al. | 219/121 LM |
| 4,723,425 | 2/1988 | Majer | 66/122 |
| 4,747,277 | 5/1988 | Majer | 66/122 |
| 4,781,040 | 11/1988 | Koike | 66/121 |

FOREIGN PATENT DOCUMENTS

| | | |
|---|---|---|
| 3546037 | 9/1986 | Fed. Rep. of Germany . |
| 3600621 | 5/1987 | Fed. Rep. of Germany . |
| 3606962 | 9/1987 | Fed. Rep. of Germany . |
| 0836297 | 6/1960 | United Kingdom . |

*Primary Examiner*—Howard N. Goldberg
*Assistant Examiner*—Irene Cuda
*Attorney, Agent, or Firm*—Spencer & Frank

[57] ABSTRACT

A method for producing the latch bearing in a latch needle for textile machines of the type in which a latch is pivotably mounted in a longitudinal slot between two cheeks of a needle shank by a hinge pin passing through mutually aligned transversely extending bores in at least one of the cheeks and a bearing portion of the latch between the cheeks. In accordance with the method a cylindrical wire is provided with transversely extending notches at intervals corresponding to the length of a hinge pin. The notched wire is converted by hot or cold treatment into a bittle, hard state. Individual hinge pins are broken off from the wire at the notches, and are subsequently inserted into the bores in the cheeks and the bearing portion of the latch to be securely fixed there.

14 Claims, 5 Drawing Sheets

METHOD FOR PRODUCING THE LATCH BEARING IN A LATCH NEEDLE FOR TEXTILE MACHINES

BACKGROUND OF THE INVENTION

The present invention relates to a method of producing the latch bearing in a latch needle for textile machines, and more particularly to such a latch needle which includes a shank having a longitudinally extending latch slot laterally delimited by needle shank cheeks, and a latch having a bearing member or portion at an end thereof inserted into the latch slot and positioned correctly therein with the use of an elongate hinge pin which is laterally inserted into laterally extending bores in at least one of the needle shank cheeks and into the bearing portion of the latch and is securely fixed in the bores in said needle shank cheeks.

The invention also relates to an apparatus for implementing this method. A prior apparatus of this kind (German Offenlegungsschriften Nos. 3,546,037 and 3,606,962) includes a clamping device for a latch needle into whose longitudinal latch slot the latch has been pre-assembled. A hole punching device o one side of the clamping device is equipped with a punch able to penetrate through the needle shank cheeks which laterally delimit the latch slot and through the bearing portion of the latch. A coaxial counter punch which is longitudinally displaceably mounted in bearing means on a side of the clamping device opposite the punch cooperates with the punch and is advanceable toward the clamping device.

The term "textile machines" is here to be understood to mean stitch forming machines, particularly knitting machines, but also specialized sewing machines and the like, in which yarn, wire and similar thread-shaped material is processed. The term "latch needle" includes all yarn etc. processing tools in which a latch or similar latch-like element is pivotally mounted in the latch slot of a shank.

In the latch needles primarily employed in practice at present, the bearing portion of the latch is generally configured so that the bearing hole disposed in the latch slot of the needle shank is mounted so as to pivot on two pivot or hinge pins pressed out of the material of the needle shank cheeks (see U.S. Pat. No. 3,934,109 and British Patent No. 836,297). The manufacturing process for this type of latch bearing is relatively simple because the configuration of the pivot pins and the installation of the latch on the pivot pins takes place practically in one process step which requires only simple and sturdy tools. Therefore, this method is quite economical, with high production rates being attainable. However, due to the unpredictable flow behavior of the material of the needle shank cheeks which is pressed into the bearing hole of the latch during the formation of the pivot pins, the pivot pins produced in this stamping process and shaped to extend from the needle shank cheeks are more or less irregularly shaped in the region of their outer peripheral faces so that the percentage of load-bearing area of the inner walls of the bearing hole for the latch on the pivot pins is relatively small. Particularly when used in fast running high performance machines, the small percentage of load-bearing area and high dynamic stresses result in a high specific load per surface area which, in turn, is the cause of premature wear phenomena.

It is known that a significantly more accurate and more wear resistant bearing for the latch can be realized in that the latch is mounted on a continuous hinge pin which has a smooth, cylindrical outer peripheral surface (see German Pat. No. 3,600,621 or the corresponding U.S. Pat. No 4,723,425). However, latch needles equipped with such a hinge pin latch bearing have not found wide acceptance in the past because manufacture and assembly of such smooth, continuous hinge pins is extremely difficult in an industrial setup due to the extremely small size of these pins. To give an idea of the order of magnitude involved, the bearing hole diameter of the latch of finer needle sizes lies at about 0.28 mm while the length of the hinge pin is about 0.35 mm.

In a prior art method for the production of latch bearings in knitting machine needles (see German Offenlegungsschriften DE-OS 3,546,037 and DE-OS 3,606,962), the needle shank is provided, before or after making the longitudinal slot, for example, with a transverse bore extending only through one shank cheek. A hinge pin whose length corresponds to approximately $\frac{2}{3}$ of the needle shank thickness is pressed into the bore and then extends through the latch hole to the abutment at the opposite shank cheek which is not provided with a bore. A subsequently applied impression which surrounds the bore in the form of a ring or a corresponding annular weld serves to securely fix the hinge pin in the bore. In this case, the hinge pin is punched out by means of a punch through a die which is aligned with the bore in the needle shank and with the latch hole on the side of the needle shank. The hinge pin is punched out of a flat wire moved past the said die and is pressed by the punch into the hole in the shank cheek. Aside from the fact that the cutting edge of the die is worn out after a short period of operation and must be reground, and the cutting edge diameter is unduly enlarged by the clearance angle present at the die, the punched out hinge pins do not have continuously smooth cylindrical outer peripheral surfaces. Moreover, the method can only be used up to a ratio of the length to the diameter of the hinge pin that is 1 or less.

SUMMARY OF THE INVENTION

It is therefore an object of the present invention to provide a way which makes it possible to economically produce a highly precise, wear resistant latch bearing for a latch needle employing a one-piece hinge pin suitable for mass production, with the hinge pin having a smooth, cylindrical outer peripheral surface and being inserted into the needle shank in a precisely predetermined length and with a precisely predetermined diameter.

To solve this problem, a cylindrical wire made of a material suitable for hinge pins is provided with transversely extending notches at intervals corresponding to the length of the hinge pin. The thus notched wire is then converted by hot or cold treatment to a brittle state and then the individual hinge pins are broken off at the notches which form desired break locations.

In a preferred embodiment, the procedure may be such that the wire is made of a hardenable metal which is hardened after the notches are cut and is then tempered in such a manner that the thus refined hard wire can be broken off in a smooth break.

The notched wire which has been made brittle can be easily and smoothly broken off at the notches, with the position of the smooth break surface, which corresponds to the surface structure of the break, being precisely determined by the notches. Since the hinge pin, when it is broken off from the hard wire, neither changes in its shape nor in its dimensions, it can effortlessly and at high speed be inserted into the intended position in the needle and is then securely arrested or fixed there by suitable means. Since the hinge pin is hard, it does not tend to grab when it is pressed into the associated bore. Small drilling inaccuracies are compensated and equalized automatically when the smooth and hard pin is pressed in.

The thus produced latch bearing therefore includes a hinge pin whose diameter and length stay within very close tolerances, with the surface of the hinge pin being manufactured with any desired fine consistency by corresponding selection or processing of the starting wire material.

It is advisable for the wire to be provided with circumferential, groove-like notches which advantageously have an essentially V-shaped cross-sectional configuration. In this way a chamfer is provided at the ends of the broken-off hinge pins to facilitate insertion into the respective bore of the needle shank cheek. The notches may be cut or recessed into the wire, for example, by means of a suitable recessing head. However, embodiments are also possible in which the notches are pressed or stamped into the wire.

For installation of the thus produced hinge pins, the procedure may be such that each hinge pin is initially broken off from the hard wire and is then inserted into the associated bores. Alternatively, one end of the hard wire can be initially pushed into the associated bores and to then be broken off from the hinge pin that remains in the bores.

Particularly in continuous processes, it is advisable for the wire coming from a wire supply to be continuously provided with notches and to then be wound, after which the notched, coiled wire is converted to the brittle state and thereafter unwound as required to permit breaking off of the hinge pins. Such a coil of notched wire may contain, for example, 200,000 and more hinge pins which all have exactly the same characteristics.

The bores in the needle shank cheeks may be produced in any desired manner. However, it has been found to be very expedient for the bores in the needle shank cheeks to be made while the pre-assembled latch needle is firmly clamped, immediately following which the hinge pin is inserted into the bores without any change in the condition of clamping. For this purpose, the bores may be punched out, for example, by means of a through hole punch.

The wire material is selected for the intended purpose. The wire material is generally steel but other materials, for example, brass, bronze or plastics, etc., are also possible. To realize specific slide effects or a reduction in wear, the wire may be coated, at least in sections, with another material before the hinge pins are broken off. The coating will here generally be applied continuously, i.e. in a flow-through process, before the notches are made, but it is also possible, in principle, to apply the coating after conversion to the brittle state. Another surface treatment for the wire, for example grinding, is also possible.

The inserted hinge pin can be arrested or fixed in the needle shank cheek in a known manner by laser welding, bead-like impressions, etc. In this connection, it is often of advantage for the inserted hinge pin to be fixed to the corresponding needle shank cheek only on one side to thus ensure a certain transverse elasticity of the needle shank cheeks in the region of the latch bearing. This transverse elasticity is utilized to friction brake and catch the latch when it is thrown into its rearward position.

An apparatus suitable for implementing the described method and including the above-mentioned features is characterized, according to the present invention, in that, between a bearing means for the counter punch and a die of a clamping means, a transfer element is provided which is movable between a receiving position and an insertion position and is provided with receiving means which accommodate at least one hinge pin to hold it in a precisely axially parallel alignment with the hole punch axis, with charging means being associated with the transfer element so as to insert one hinge pin into the receiving means when the transfer element is in the receiving position. When the transfer element is in the insertion position, the hinge pin held in its receiving means then has its axis aligned with the hole punch axis so that the pin ca easily be inserted into the bore of the adjacent needle shank cheek with the counter punch.

Particularly simple structural conditions result if the transfer element includes a flat pusher, that is, a member of substantially rectangular cross section which slides transversely along a surface of the die. In this case, the pusher is advantageously provided with a continuous bore which extends is parallel to the hole punch axis, serving as the receiving means, with a hinge pin being held in such a bore in sliding seat.

A continuous process can be realized with a simple apparatus in which the charging means includes a transporting device which advances the notched hard wire in steps and with which one end of the wire can be inserted into the receiving means of the particular transfer element that is presently in the receiving position. The transfer element is associated with a breaking means which produce a bending movement between the wire and the end portion thereof which is held in the receiving means. These breaking means may include a pivotally mounted abutment which guides the notched hard wire between the transporting device and the transfer element.

BRIEF DESCRIPTION OF THE DRAWINGS

These and other features and advantages of the invention will be more completely understood from the following detailed description of a preferred embodiment with reference to the accompanying drawings in which.

DESCRIPTION OF THE PREFERRED EMBODIMENT

Figure 7:
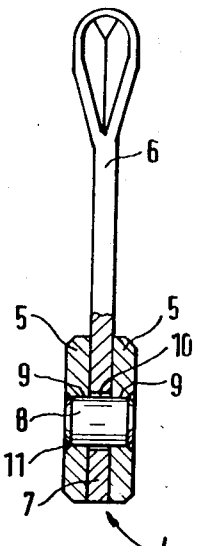
FIG. 7 is a sectional view to an enlarged scale of the latch needle of FIG. 8 seen along line VII—VII of FIG. 8, with the latch pivoted up and showing the latch bearing produced according to the present invention.
Figure 8:
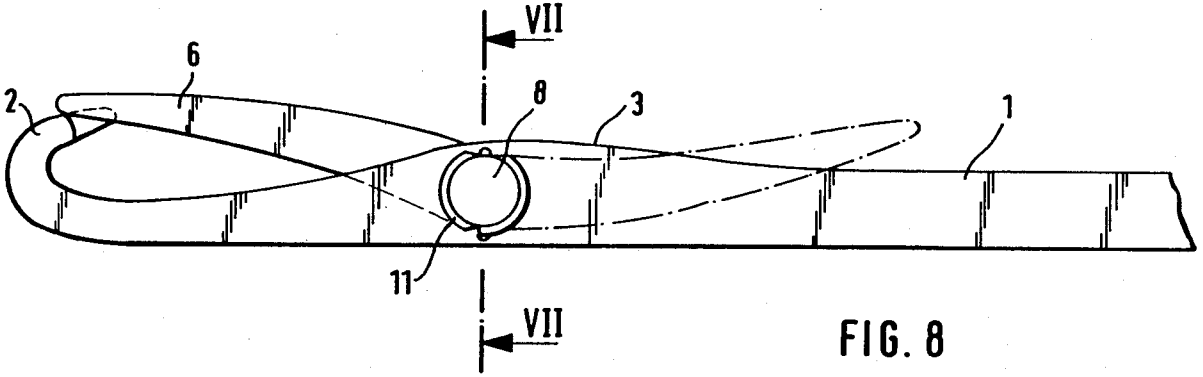
FIG. 8 is a side view of the stitch forming portion of a latch needle equipped with a latch bearing produced according to the invention.
Figure 9:
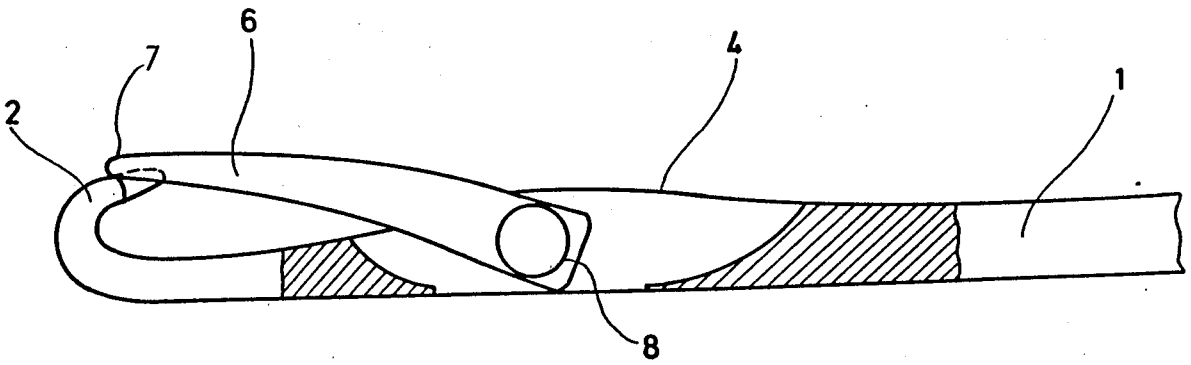
FIG. 9 is a side view, partially in cross section, of the latch needle portion shown in FIG. 8.

The latch needle shown in FIGS. 7, 8 and 9 includes a needle shank 1 which may possibly be equipped with an integrally punched out needle butt followed at one end by a needle hook 2. In the region of the needle cheek 3, a longitudinally extending latch slot 4 is formed in the needle shank 1 and is provided, in the customary manner, with a passage to the underside of the needle shank. Latch slot 4 is delimited on either side by a respective needle shank cheek 5; in it, a needle latch 6 is pivotally mounted with its bearing member or bearing portion 7 lying within the latch slot 4.

The latch bearing comprises a smooth-walled, cylindrical hinge pin 8 which is inserted into corresponding cylindrical, transversely extending, aligned holes or bores 9 of needle shank cheeks 5. Latch 6 is mounted so as to pivot on this hinge pin 8 with little bearing play by means of a transversely extending bearing bore 10 formed in its bearing member 7. Preferably, hinge pin 8 is arrested or fixed in one of the two bores 9 so as to be held in an axially inescapable way. For this purpose, one of its ends is welded at 11 to the associated needle shank cheek 5, for example by means of a laser beam, while its other end is merely supported in the associated bore 9 of the other needle shank cheek 5 in such a manner that needle shank cheeks 5 retain their elastic transverse mobility. However, it is also conceivable to arrest or fix the hinge pin 8 in bores 9 so that they are axially secured.

The production of this latch bearing will now be described with reference to FIGS. 1 to 6.

Figure 2:
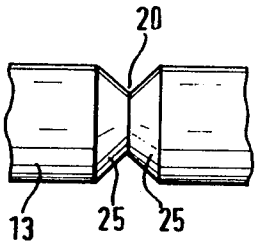
FIG. 2 is a sectional view to an enlarge scale of the wire notched with the apparatus according to FIG. 1, illustrating one notch.
Figure 1:
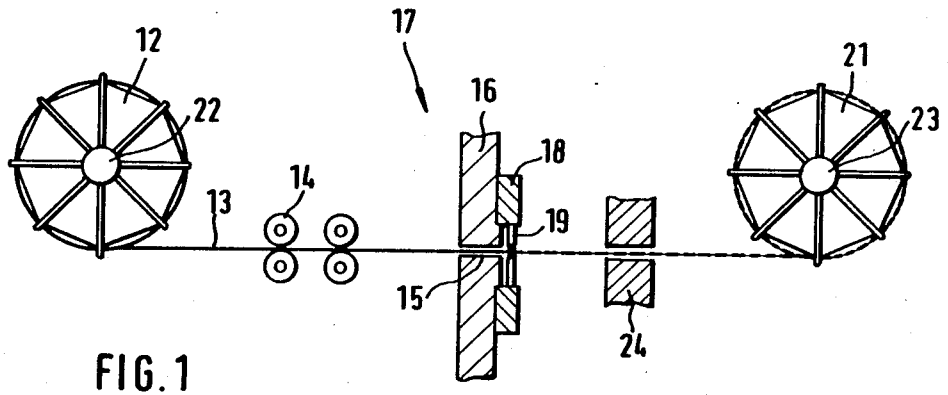
FIG. 1 is a schematic representation in a side view, partially in section, of a device according to the invention for notching a wire intended for the production of hinge pins.

In FIG. 1, a cylindrical metal wire, particularly a steel wire, is shown wound onto a reel 12. This wire has a smooth surface and its diameter corresponds precisely to the desired diameter of hinge pin 8. This wire 13 is unwound in stages from the correspondingly driven reel 12; it initially moves through aligning rolls 14 where it is set to be precisely straight. The aligned wire 1 3 is transported through the guide channel 15 of a stationary guide member 16 of a notching device 17. Guide member 16 carries a cutting head 18 which is coaxial with the axis of channel 15. The interior of cutting head 18 is equipped with a milling tool 19 having such a profile that it cuts circumferential notches 20 (FIG. 2) of an essentially V-shaped cross-sectional configuration into the stopped wire 13. A likewise driven second reel 21 winds up the notched wire 13.

The two reels 12, 21 are driven stepwise by associated stepping drives 22, 23 so that milling tool 19 cuts successive notches 20 into the wire at intervals corresponding to the length of the hinge pins.

Instead of circumferential notches 20, any other type of oppositely disposed notches could be produced in notching device 17 at intervals corresponding to the length of the hinge pins, for example, oppositely disposed notches, and it would also be possible not to cut or punch the notches in a milling process but to stamp or press them in.

If necessary, wire 13 may be coated with another material before or after the cutting of notches 20 in a continuous process taking place in a coating station indicated at 24, to thus produce special sliding effects or an additional reduction of wear in the latch bearing.

The wire 13 wound on reel 21 which has about 200,000 or more notches 20 in it is then treated as by heating and/or cooling processes in such a manner that it takes on a brittle, hard state. In this state, wire 13 can be unwound without difficulty from reel 21, but simply bending the wire at notches 20, which act as desired break locations, easily divides the wire into individual hinge pins 8. This breaking off produces smooth break surfaces which start at the bottom of the respective V-shaped notches 20 and extend at a right angle to the axis of the wire. At the same time, the breaking process causes the frustoconical side walls 25 of each notch 20 to produce a chamfer at the frontal face of the presently cut hinge pin 8, with the shape of this chamfer being given by milling tool 19 and not being changed by the treating and breaking processes.

The thus notched and hardened wire 13 is fed to the device shown in FIGS. 3 to 6. This device includes a support 26 of accurate dimensions and a counter support or female piece 27 following the support on one side. Together with a clamping jaw 28 mounted so as to be moved toward and away from counter support 27, the latter forms clamping means for a partially pre-assembled latch needle whose needle shank 1 is clamped between counter support 27 and clamping jaw 28 in the region of the needle shank cheeks 5 resting on support 26 in a manner shown in FIGS. 3 to 6. In a previous assembly step, latch 6 is inserted into longitudinal latch slot 4 and is stationarily positioned therein in such a manner that its bearing hole 10 has a precisely predetermined spatial orientation.

In clamping jaw 28, which simultaneously serves as a punch guide, a guide bore 29 is formed in which a cylindrical punch 30 is mounted so as to be slideably moved back and forth and whose axis is coincident with the axis of a bore 31 of counter support 27. The pivotal axis of latch 6 of the pre-assembled latch needle is also aligned with the axis of punch 30.

Spaced opposite counter support 27, a bearing means in the form of guide block 32 is disposed which includes a cylindrical guide bore 33 serving as a slide bearing that is axially aligned with bore 31 in counter support 27 and in which a impression or counter punch 34 is longitudinally movably guided. Thus, counter punch 34 is aligned with bore 31 in counter support 27.

Figures 3, 4:
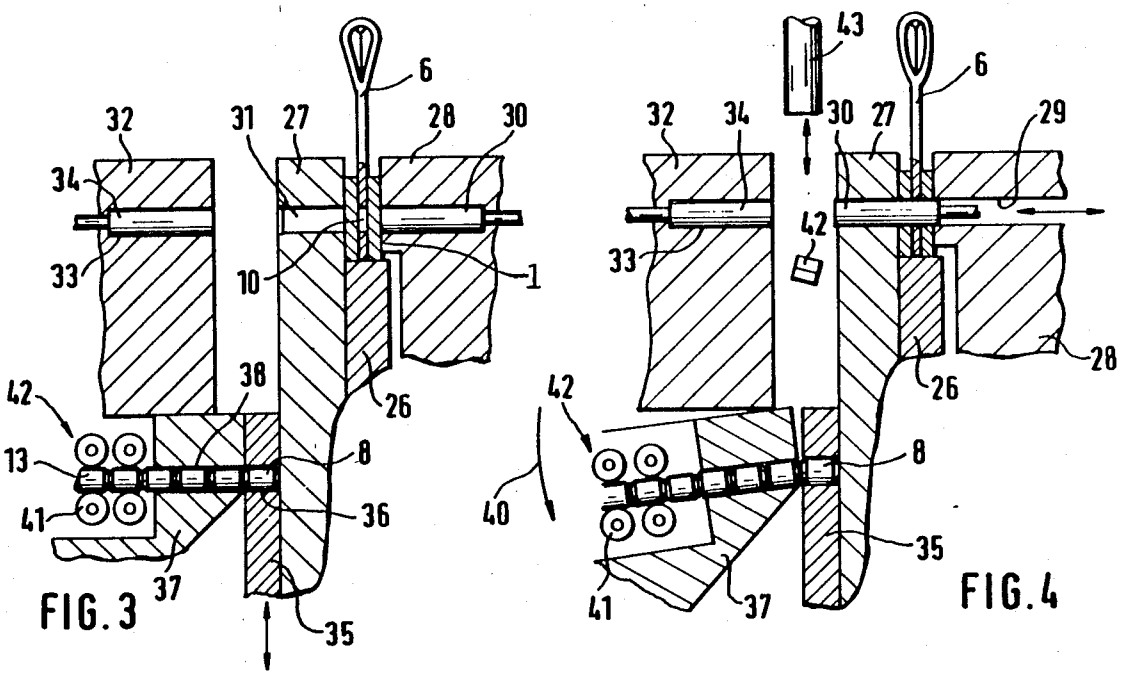
FIGS. 3 to 6 are partially schematic side cross-sectional view of an apparatus according to the invention for the production of the latch bearing of a latch needle, showing four different successive operational stages.
Figure 6:
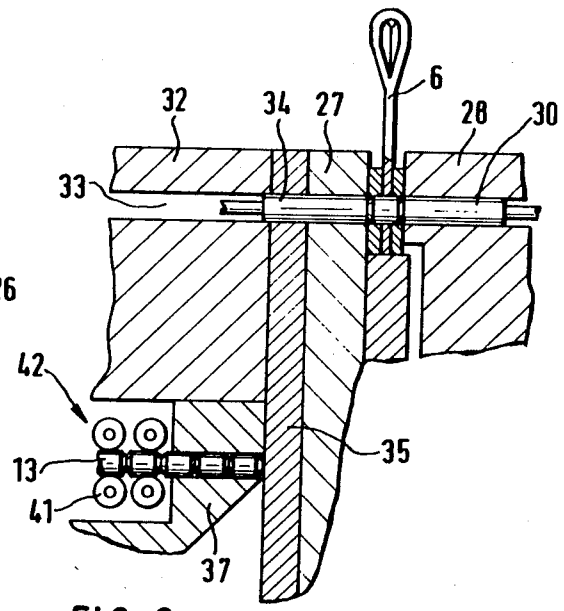

In the space between counter support 27 and guide block 32, a transfer element in the form of a pusher 35 is guided to be displaceable between a receiving position shown in FIG. 3 and an insertion position shown in FIG. 6. Pusher 35 is rectangular in cross section and lies against the side face of counter support 27. Pusher 35 is provided with a cylindrical through bore 36 which serves as a receiving means and into which a hinge pin 8 can be inserted in a sliding fit. The thickness of pusher 35 is somewhat greater than the length of a hinge pin 8.

Below guide block 32 following and next to pusher 35, there is disposed a guide and abutment element 37 which is equipped with a cylindrical through bore 38 and is mounted so as to be pivotable slightly downwardly, as shown in FIG. 4 by arrow 40. A transporting device 42 driven in steps and provided with transporting rollers 41 is provided at guide and abutment element 37 to permit the advancement of a notched hard wire 13 inserted into guide bore 38, in steps of one length of a hinge pin, to the right with respect to FIG. 3.

The device described above operates as follows:

Once a latch needle having a pre-punched latch 6 has been clamped in the above-described manner between the counter support 27 and the clamping jaw 28 with hole punch 30 in the retracted position, the assembly of the hinge pins can begin. Transporting device 42 pushes the end of the notched and tempered wire 13 corresponding to one hinge pin 8 and coming from reel 21 into bore 36 of pusher 35 which is in its receiving position. Guide and abutment block 37 then takes on its upper position in which its guide bore 38 is aligned with the bore 36 of pusher 35 as shown in FIG. 3.

Now, punch 30 is moved to the left with reference to FIG. 3, thus cutting a straight bore 9 out of the two needle shank cheeks. The two cut pieces 42 drop into the space between counter support 27 and guide block 32 and are blown away by means of a jet of air supplied through a nozzle 43.

At the same time, guide and abutment element 37 is pivoted slightly downwardly, thus smoothly breaking off, at the associated notch 20, the end of wire 13 held in bore 36 of pusher 35 and corresponding to the length of one hinge pin 8 as shown in FIG. 4.

Now, starting from its receiving position of FIG. 4, pusher 35 is moved upwardly into its insertion position in which bore 36 containing the broken-off hinge pin 8 is aligned with bore 31 of counter support 27.

At the same time, guide and abutment element 37 has returned to its starting position shown in FIG. 3.

Figure 5:
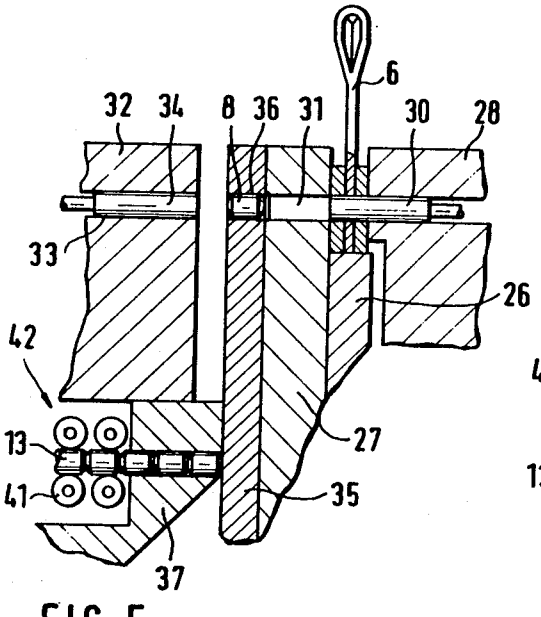

Punch 30 has been retracted to such an extent that its frontal face is approximately flush with the facing side wall of counter support 27, as shown in FIG. 5.

With pusher 35 arrested or fixed in its insertion position, impression or counter punch 34 is now advanced to the right with reference to FIG. 6, which thus pushes hinge pin 8 out of bore 36 of pusher 35 into bore 31 of counter support 27 and thus into bores 9 previously produced by punch 30 in needle shank cheeks 5. During this step of pressing in hinge pin 8, hole punch 30 constitutes the counter punch which accurately determines the insertion depth of hinge pin 8, as shown in FIG. 6.

In the next following process step, impression and counter punch 34 is again retracted to its starting position shown in FIG. 3 while clamping jaw 28 is moved to the right with reference to FIG. 6 so that the assembled latch needle can be removed and replaced by a new, partially pre-assembled latch needle.

Moreover, pusher 35 has now been lowered again to its transfer position shown in FIG. 3 in which its bore 36 is aligned with guide bore 38 of guide and abutment element 37. As soon as pusher 35 has reached this position, the transporting device 42 again pushes wire 13 to the right with reference to FIG. 3, by an amount corresponding to the length of one hinge pin 8, thus again reaching the starting state shown in FIG. 3.

The assembled latch needle taken from the device is now subjected to further processing. For this purpose, at least one frontal face of the inserted hinge pin 8 is initially ring welded to the associated needle shank cheek 5 in a device not shown here, or is otherwise secured; then the latch needle is hardened, polished, etc. i.e. brought to its final marketable state.

The described device is distinguished by very simple manipulation of hinge pins 8 because the latter are supplied contiguously, separated only by notches 20, in the form of a wire on a reel. Alternatively, embodiments are possible in which the individual hinge pins 8 are broken from the notched and hardened wire in a separate process step and are then taken over by a transfer element and brought into the effective range of impression or counter punch 34.

In the described embodiment of the method, the notched metal wire 13 formed for example of steel, is converted by heat treatment and subsequent tempering, or similar treatment, to a brittle state. However, it is also possible, in principle, to cool wire formed of a material, such as brass, bronze, plastics etc., to such a low temperature that it is converted to such a state. This cooling may be effected, for example, with liquid air or liquid nitrogen. In this way, it can be accomplished that the material of the hinge pins 8 inserted into the bores 9 of needle shank cheeks 5, when reheated to ambient temperature, retains its original characteristics. Additionally, the enlargement in diameter occurring during heating can also be utilized to arrest or fix hinge pin 8 in needle shank cheeks 5.

The present disclosure relates to the subject matter disclosed in Federal Republic of Germany Patent application No. P 38 00 802.5-14 filed Jan. 14th, 1988, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. A method of producing a latch bearing in a latch needle for textile machines, comprising the steps of:

providing a partially assembled latch needle having a needle shank and a latch, the shank having a longitudinally extending latch slot and a pair of shank cheeks laterally delimiting the slot and having respective laterally extending axially aligned bores, the latch having at an end thereof a bearing portion, the bearing portion having a bearing bore and being positioned in the slot such that the bearing bore is axially aligned with the bores in the cheeks;

forming notches in a cylindrical wire, the notches extending transversely of the length of the wire and being spaced along the length of the wire to define respective pieces of the wire between the notches;

treating the notched wire so as to bring the notched wire to a brittle, hard state by at least one of heating and cooling the notched wire;

breaking off the pieces of the brittle hard wire at the notches; and inserting one of the pieces into at least one of the bores in the cheeks and the bearing bore of the partially assembled latch needle to serve as a hinge pin for the latch needle.

2. A method as in claim 1, wherein the wire is composed of a hardenable metal and said step of hardening comprises the step of tempering the wire such that said step of breaking produces smooth breaks at said notches.

3. A method as in claim 1, wherein said step of forming notches comprises the step of forming circumferential groove-like notches in the wire.

4. A method as in claim 1, wherein the notches have a V-shaped cross section.

5. A method as in claim 1, wherein said step of forming notches comprises the step of cutting the notches into the wire.

6. A method as in claim 1, wherein said step of forming notches comprises the step of punching the notches into the wire.

7. A method as n claim 1, wherein said step of forming notches comprises the step of pressing the notches into the wire.

8. A method as in claim 1, wherein said step of forming notches comprises the step of stamping the notches into the wire.

9. A method as in claim 1, wherein said step of breaking off is performed before said step of inserting.

10. A method as in claim 1, wherein said steps of inserting and breaking off comprise the step of inserting an end of the hardened wire into the at least one of the bores in the cheeks and the bearing bore until one of the pieces is disposed therein and then breaking off the piece at a notch delimiting the piece.

11. A method as in claim 1, wherein the step of forming the notches is performed continuously on the wire, the method further comprising the step of winding up the wire as the notches are formed, the step of treating the notched wire being performed in the wound state after said step of winding, the hardened and brittle wire being unwound to break off the pieces as required.

12. A method as in claim 1, further comprising the steps of clamping the partially assembled latch needle in a predetermined clamped position and holding the partially assembled latch needle in the predetermined clamped position while successively punching the bores in the needle shank cheeks and performing said step of inserting.

13. A method as in claim 1, further comprising the step of coating the wire with another material before said step of breaking off.

14. A method as in claim 1, further comprising the step of fixing only one side of the piece forming the hinge pin in the bores in the cheeks.

* * * * *